United States Patent [19]

Riesen et al.

[11] Patent Number: 4,832,089

[45] Date of Patent: May 23, 1989

[54] PROJECTILE-CATCHING BRAKE FOR A LOOM

[75] Inventors: Peter Riesen, Elgg, Switzerland; Walter Gruber, Constance, German Democratic Rep.

[73] Assignee: Sulzer Brothers Limited, Winterthur, Switzerland

[21] Appl. No.: 157,381

[22] Filed: Feb. 18, 1988

[30] Foreign Application Priority Data

Mar. 5, 1987 [CH] Switzerland ..... 00827/87

[51] Int. Cl.[4] ..... D03D 49/54

[52] U.S. Cl. ..... 139/185; 188/274

[58] Field of Search ..... 139/438, 439, 196.2, 139/185, 186, 187; 264/251 A, 251 M, 264 R, 264 D, 264 P; 188/274, 279, 271

[56] References Cited

U.S. PATENT DOCUMENTS

| | | | |
|---|---|---|---|
| 2,538,798 | 1/1951 | Pfarrwaller | 139/439 |
| 3,865,150 | 2/1975 | Demuth | 139/185 |
| 3,939,878 | 2/1976 | Pfarrwaller | 139/196.2 |
| 4,669,511 | 6/1987 | Steiner | 139/185 |

*Primary Examiner*—Henry S. Jaudon

*Attorney, Agent, or Firm*—Kenyon & Kenyon

[57] ABSTRACT

The projectile-catching brake employs at least one resilient brake shoe which is made of metal for use with plastic projectiles. Where used with steel projectiles, the brake shoe may be provided with an insert of plastic material which can be replaced from time-to-time. In some embodiments, the resilient brake shoe is formed of a hollow section member to define a cavity through which air or other coolant may flow. In still other embodiments, bent stampings are used to form the brake shoes. A brake shoe body of metal may also be mounted by spaced apart resilient plastic strips.

13 Claims, 3 Drawing Sheets

PROJECTILE-CATCHING BRAKE FOR A LOOM

This invention relates to a projectile-catching brake for a loom.

As is known, looms have been provided with various types of brakes for catching projectiles. Generally, the brakes have employed brake shoes which have a surface to cooperate with a part of the projectile surface in order to define a pair of opposed braking surfaces between which a projectile may be brought to a halt.

The main requirements to be fulfilled by such brakes in a loom are reliable retardation of projectiles so that the projectiles stop at a predetermined place without knocks on the projectiles causing mispicks, reduced wear and low service costs. Various devices have been known which provide for these requirements to be met up to a particular level of performance. This applies to the generally conventional use of steel projectiles. For example, Russian Patent No. 937,560 describes a catching brake having a metal plate as a support and a nonreinforced polymer layer thereon to increase working life. However, this brake is not resilient. Consequently, knocks and mispicks may occur and picking speeds cannot be high.

The use of resilient plastics, particularly polyurethanes, for braking shoes, for example as described in Swiss Patent No. 553,269 offers some improvements. In this case, attempts have been directed towards devising a simplified replacement of the plastics parts. European Patent No. 0189490 describes an improved construction of elastomer brake shoe wherein elastomer plates are disposed on either side of a metal support plate. In this case, one elastomeric plate is relatively hard and is operative as a long-life brake lining while the other elastomeric plate is softer and is used for damping purposes.

Unfortunately, all of the known devices which have been used only for steel projectiles have reached the final limit of performance. In this respect, as is known, as projectile speed increases, the kinetic energy to be retarded rises with the square of the speed. As a result, heating of the braking surfaces of the projectile and brake increases correspondingly in an intensive manner. This leads to softening and destruction of the plastics and the elastomers used and to sharply rising and unacceptable wear. In addition, changes occur in the braking pressures and in the coefficients of friction of the brake linings with the result that unwanted variations in the braking force occur leading to the impossibility of stopping the projectiles in the required narrow zone. Thus, the projectiles either overshoot or undershoot, with the result of failure of braking, defects and consequential damage.

Picking speed and weaving output can be considerably increased by using new plastic projectiles in place of conventional steel projectiles. However, the above devices which use plastic and elastomeric brake shoes cannot be used in looms for plastic projectiles.

A known more developed catching brake having an additional metal brake plate on the elastomeric brake shoes cannot overcome these fundamental shortcomings of performance and speed for a further considerable problem arises with plastics projectiles. That is, most of the heat of braking-up to 90% and more—must be absorbed by the brake. Conversely, with steel projectiles, by far the largest proportion of the heat of braking is taken up by the projectile and can be yielded to the environment during the relatively long return movement. Conventional catching brakes for steel projectiles, with their very reduced ability to dissipate heat therefore are basically not suitable for plastics projectiles.

Another problem arising at high picking rates and correspondingly high braking powers is that not only is there a correspondingly intense average heating of the brake and projectiles but also some parts of the brake and the projectiles may experience very dangerous local temperature peaks which are considerably above the average brake surface temperature and which inevitably lead to the destruction of the plastic surface as a result of softening, chemical decomposition and plastic deformation. This, in turn, leads to unacceptably high wear, frequent defects, malfunctioning and consequential damage to the looms, with correspondingly high servicing and repair costs.

Accordingly, it is an object of the invention to provide a projectile-catching brake suitable for high picking rates.

It is another object of the invention to provide for heat dissipation in a projectile-catching brake for a loom.

It is another object of the invention to provide a brake having constant braking properties.

It is another object of the invention to provide a projectile-catching brake which can be used for steel projectiles and for light weight plastic projectiles.

It is another object of the invention to increase the working life of a projectile-catching brake.

Briefly, the invention provides a projectile-catching brake for a loom which is comprised of a pair of brake shoes having opposed braking surfaces for catching and braking a projectile therebetween wherein at least one of the brake shoes is made of metal and of a resilient structure.

In a case where the projectiles are made of metal, each of the brake shoes has an abrasion-resistant plastic insert to define the braking surface thereof. For example, the insert may be a thin layer of fiber reinforced nylon of a thickness of at most one millimeter. In addition, the insert is removably mounted in the respective shoe for replacement purposes from time-to-time.

Where the projectiles have plastic surfaces, the brake shoes have metal braking surfaces.

Advantageously, the brake is mounted in a loom with resilient brake shoes disposed opposite one another on either side of a projectile so that impacts which occur when the projectile impinges in the catching brake are better absorbed.

In other constructions, at least two resilient brake shoes can be disposed one after another in the direction of picking with the shapes and resilience of the shoes possibly differing from one another. Since a unitary brake heats up most in the front part near the projectile entry, heating may be equalized, for example, by using a two-part brake with a rear part being harder than the front part or, in general terms, a progressive brake can be provided.

In one embodiment, the resilient brake shoe is in the form of a hollow section member which is stressable in bending. In this case, there is a very good ratio of large brake surface to very reduced unsprung weight, thus further reducing impacting of the projectile. The large area and the rapid heat distribution of the heat-conducting metal form greatly improves removal of braking heat to the ambient air and considerably reduces local temperature peaks.

Because of the metal construction of the brake shoes, the braking properties remain constant even at very high braking forces since there is no softening nor chemical dissociation. Preferably, a large brake contact area is provided corresponding to at least half the generative surface of the projectile, if possible, including the inclined guide surfaces. This is with a view to reducing braking pressures and specific wear and to distributing the heat of braking over a large area to give correspondingly lower temperatures.

The projectile brake may be further improved by using a cooler in which a coolant in guided by a suitable conveying or guide means to flow into the vicinity of the braking surface. For example, water may be used as a coolant to be guided through ducts or tubes in heat conductive contact with the brake shoes.

These and other objects and advantages of the invention will become more apparent from the following detailed description taken in conjunction with the accompanying drawings wherein.

Figure 1:
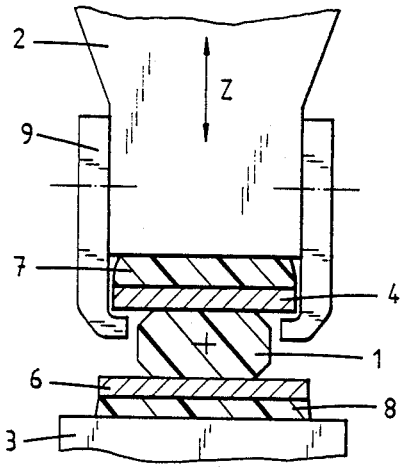
FIG. 1 illustrates a cross-sectional view of a conventional projectile brake for a loom.

Referring to FIG. 1, the brake is constructed for catching a plastic projectile 1 within a loom. As indicated, the brake includes a rubber pad 7, for instance, of resilient polyurethane, a steel brake plate 4 in engagement therewith and lateral guide plates 9 secured to a top brake mounting 2 which is vertically reciprocable as indicated by a double arrow Z. A bottom brake mounting 3 carries a bottom rubber pad 8 and a bottom brake plate 6 which together with the plate 4 forms the metal side of the braking-surface pairing in respect of the plastic surface of the projectile 1. The heat of friction arising in braking heats the plates 4, 6 very considerably. However, the pads 7, 8 which are required for springing and damping and which are several millimeters thick make it virtually impossible for the heat of braking to be removed to the mountings 2, 3. Substantially no heat can be removed by way of the side plates 9 either since the moving plate 4 must always have some clearance from the fixed plates 9. At high picking speeds, the plates 4, 6 and the plastic surface of the projectile 1 become hotter and hotter, leading in the first place to rapidly increasing wear and finally to melting and breakdown of the plastic surface and, therefore, to a malfunctioning of the loom. Even if the disadvantage of the brake being sprung just at one end can be tolerated by the omission of the bottom pad 8, heat builds up just as intensely at the top pad 7.

Figure 2:
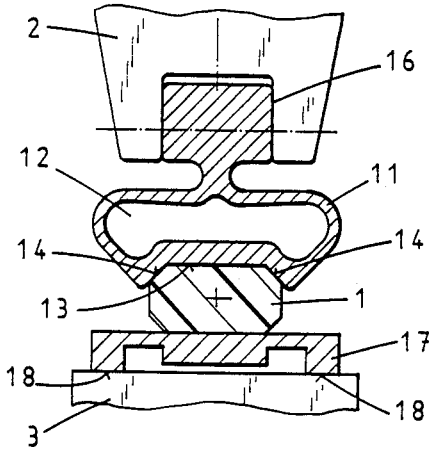
FIG. 2 illustrates a cross-sectional view of a brake constructed in accordance with the invention.

Referring to FIG. 2, the projectile-catching brake according to the invention has a brake shoe 11 which is secured to a top mounting 2 and which is made, in this case, entirely of metal. The shoe 11 is in the form of a hollow section member having an interior 12 to provide self-springing properties. This structure is basically a flat-pressed O-shaped steel spring which is stressed in bending, the interior 12 being open at the front and at the rear in the picking direction—i.e., in the direction of viewing in the present case—so that air can flow through the interior 12 to provide cooling. Some movement of air is produced just by the operation of the loom; however, additional forced ventilation can be provided.

The shape of the metal brake shoe 11 provides a substantial brake contact surface 13 and a large area in order to reduce specific loading and wear of the materials used for braking and to achieve substantial heat removal and a substantial heat transfer to the environment. The surface 13 comprises not only a top covering surface over the projectile 1 but also two lateral guide surfaces 14 for guiding the projectile 1 in the guide teeth (not shown) of the loom.

The bottom metal brake shoe 17 of this embodiment is also a self-springing sprung plate and is mounted on a bottom mounting 3 via two mounting surfaces 18.

Relatively large metal contact surfaces 16, 18 and adequate pressure ensure a satisfactory heat transfer from the shoes 11, 17 to the mountings 2, 3. As will be apparent from FIG. 2, the brake shoe 11 provides the required advantages, namely light unsprung weights and a large heat-conducting surface to dissipate the heat of braking. In contrast to the known elastomer-sprung brakes of FIG. 1, the metal brakes provide constant braking properties i.e., the coefficient of friction, spring rates and spring forces remain substantially independent of the operating temperature of the brake. Only if braking properties are constant can the projectile 1 be reliably stopped in a predetermined zone. Conventional elastomeric brakes suffer, for example, from considerable differences between their cold state at start-up of the loom and their state when hot in operation, so that continuous adjustment and re-adjustment are necessary.

Figure 3:
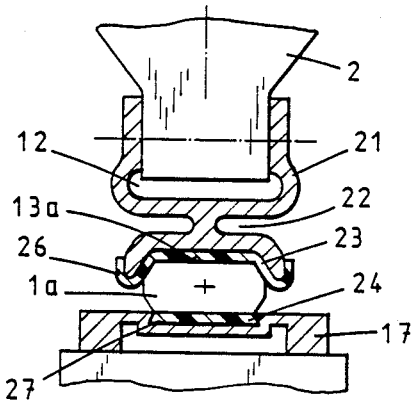
FIG. 3 illustrates a modified brake constructed in accordance with the invention.

FIG. 3 shows another embodiment of a resilient (self-sprung) brake shoe having a closed profiled space 12 and open gaps 22 again leading to a large heat-exchange area of metal. When used for steel projectiles representing the metal side of the pair of braking surfaces, a thin insert 23, 24 of abrasion-resistant plastic is applied to the metal brake shoes 21, 17 in a thickness, for example, of from 0.5 to 1 millimeter. Preferably, these inserts are in the form of readily replaceable replacement parts which, as a result of appropriate shaping of the brake shoes, can be pushed on via flanges 26 or engaged in a dovetail guide 27. Consequently, the same brake pairing between metal and abrasion-resistant plastics occurs on the brake contact surface 13*a* as in FIG. 2. A decisive factor in both cases is that the plastics side of the brake pairing is not responsible for springing and damping and can therefore be completely designed for optimum stability and abrasion resistance.

Figure 4:
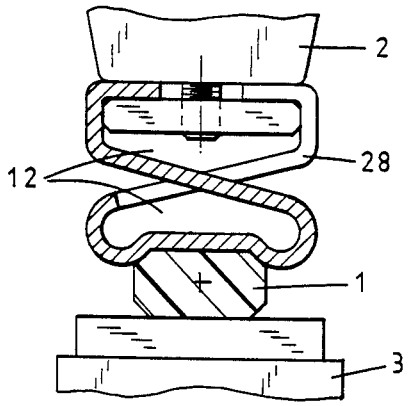
FIG. 4 illustrates a modified brake formed of a bent stamping in accordance with the invention.
Figure 5:
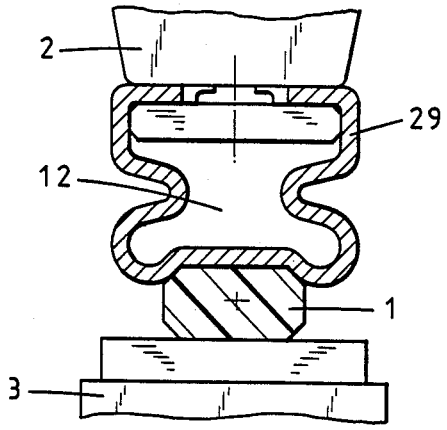
FIG. 5 illustrates a modified brake made from a stamping in accordance with the invention.

FIGS. 4 and 5 show other possible constructions of self-sprung brake shoes made from simple-to-make and low-cost bent stampings 28, 29 of steel sheet. Again, a large surface and a high degree of heat dissipation are achieved. Referring to FIG. 4, the stamping 28 has a plurality of webs which are disposed in crossing relation to each other and a plurality of flanges disposed in facing relation to each other.

Figure 6:
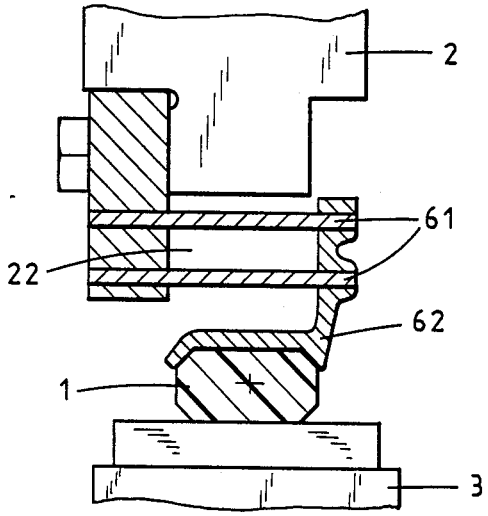
FIG. 6 illustrates a further modified brake employing resilient plastic strips in accordance with the invention.

Referring to FIG. 6, a self-sprung form of brake shoe with spaces is achieved by combining a stationary metal body 62 with transverse spring strips 61 secured to the body 62 for guiding the body 62. The strips 61 are made of fiber reinforced plastic, carbon and glass fibers being particularly suitable. As illustrated, the strips 61 define an open space or gap 22 to provide for good heat dissipation.

Figure 7:
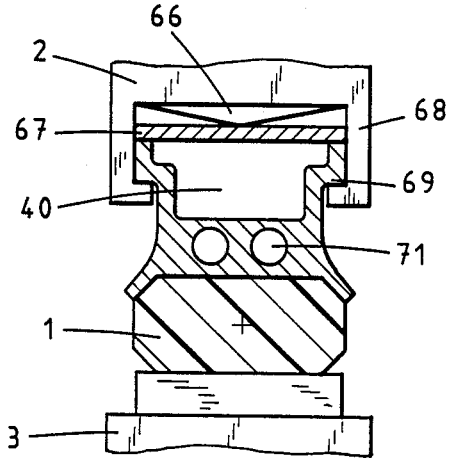
FIG. 7 illustrates a cross-sectional view of a further modified brake in accordance with the invention employing a plastic spring.

Referring to FIG. 7, wherein like reference characters indicate like parts as above, the brake shoe may be constructed of a hollow metal body 69 which defines the braking surface, a wedge 66 disposed on the top mounting 2 and a plastic spring 67 between the wedge 66 and the body 69 for deflecting under a projectile-imposed force on the body 69. As indicated, the body 69 is guided within a side mounting 68 depending from the top mounting 2 and defines an inner space 40 with the spring 67 through which air may flow for cooling purposes. When a projectile 1 passes under the rigid metal body 69, the plastic spring 67 deflects about the wedge 66.

A particularly efficient construction of the brake can be provided if a cooler is provided both to dissipate the heat of braking evolved and to reduce local temperature peaks. In this case, coolant may be guided by suitable conveying or guide means in a directed flow to the vicinity of the braking surface. As indicated in FIG. 7, a plurality of ducts 71 are provided in the body 69 very near the braking surface to convey a liquid coolant therethrough.

Figure 8:
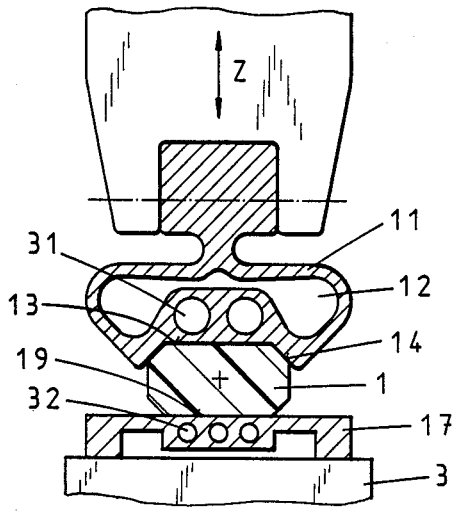
FIG. 8 illustrates a cross-sectional view of a modified brake employing cooling ducts in accordance with the invention.
Figure 9:
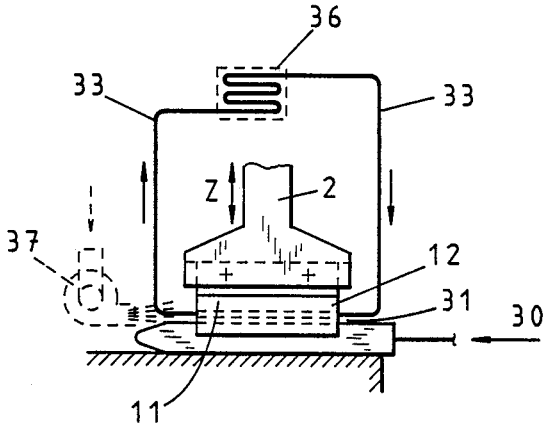
FIG. 9 illustrates a brake in combination with a cooling system in accordance with the invention.

Referring to FIGS. 8 and 9, wherein like reference characters indicate like parts as above, a fan 37 may be used to supply cooling air along a picking track 30 of the projectile and through the interior 12 of a brake shoe 11. Alternatively, liquid cooling may also be provided via cooling ducts 31, 32 passing through the resilient brake shoes 11, 17 (see FIG. 8) or with cooling tubes which are in heat-conductive contact with the brake shoes. Intensive cooling can thus be provided very near the surfaces 13, 19. As indicated in FIG. 9, the cooling liquid which has been heated by the brake shoes returns through flow lines 33 to a heat exchanger 36 and then flows back to the cooling ducts 31 of the brake shoe.

The invention thus provides a projectile-catching brake which can be used with projectiles of steel or plastic and, particularly with projectiles which are picked at very high speeds and picking rates.

The invention further provides a projectile-catching brake which is able to dissipate heat generated during braking in a relatively efficient manner.

What is claimed is:

1. A projectile-catching brake for a loom comprising a pair of brake shoes having opposed metallic braking surfaces for catching and braking a projectile having a plastic braking surface thereon, at least one of said brake shoes being made of a resilient metal structure.

2. A projectile-catching brake as set forth in claim 1 wherein said one resilient shoe is a hollow section member.

3. A projectible-catching brake as set forth in claim 1 wherein said resilient shoe is a bent stamping having a plurality of webs disposed in crossing relation to each other and a plurality of flanges disposed in facing relation to each other.

4. A projectile-catching brake as set forth in claim 1 wherein said metal brake shoe includes means for directing a flow of coolant into the vicinity of said braking surface.

5. A projectile-catching brake for a loom comprising a pair of brake shoes having opposed metallic braking surfaces for catching and braking a projectile having a plastic braking surface thereon, at least one of said brake shoes including a metal body defining said braking surface and a plurality of spring strips of plastic secured transversely to said body for mounting of said body on a support.

6. A projectile-catching brake for a loom comprising a pair of brake shoes having opposed metallic braking surfaces for catching and braking a projectile having a plastic braking surface thereon, at least one of said brake shoes including a hollow metal body defining said braking surface, a wedge and a plastic spring between said wedge and said body for deflecting about said wedge under a projectile imposed force on said body.

7. A projectile-catching brake for a loom comprising a pair of brake shoes having plastic braking surfaces thereon for catching and braking a metal projectile therebetween, at least one of said brake shoe being made of a resilient metal structure.

8. A projectile-catching brake as set forth in claim 7 wherein each of said shoes has an abrasion-resistant plastic insert defining said plastic braking surface thereof.

9. A projectile-catching brake as set forth in claim 8 wherein each insert is removably mounted in said respective shoe.

10. A projectile-catching brake as set forth in claim 8 wherein each insert is at most 1 millimeter thick.

11. A projectile-catching brake as set forth in claim 7 wherein said one resilient shoe is a hollow section member.

12. A projectile-catching brake as set forth in claim 7 wherein said resilient shoe is a bent stamping having a plurality of webs disposed in crossing relation to each other and a plurality of flanges disposed in facing relation to each other.

13. A projectile-catching brake as set forth in claim 7 wherein said metal brake shoe includes means for directing a flow of coolant into the vicinity of said braking surface.

* * * * *